US006311772B1

(12) United States Patent
Myhre et al.

(10) Patent No.: US 6,311,772 B1
(45) Date of Patent: Nov. 6, 2001

(54) HYDROCARBON PREPARATION SYSTEM FOR OPEN HOLE ZONAL ISOLATION AND CONTROL

(75) Inventors: Morten Myhre, Tananger (NO); Benn A. Voll, Houston; Martin P. Coronado, Cypress, both of TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/427,846

(22) Filed: Oct. 26, 1999

Related U.S. Application Data

(60) Provisional application No. 60/106,794, filed on Nov. 3, 1998.

(51) Int. Cl.[7] ..... E21B 43/08

(52) U.S. Cl. ..... 166/278; 166/51; 166/280

(58) Field of Search ..... 166/276, 51, 278, 166/280, 321

(56) References Cited

U.S. PATENT DOCUMENTS

| | | | | |
|---|---|---|---|---|
| 3,710,862 | | 1/1973 | Young et al. | 166/278 |
| 4,105,069 | | 8/1978 | Baker | 166/51 |
| 4,273,190 | | 6/1981 | Baker et al. | 166/278 |
| 4,341,266 | * | 7/1982 | Craig | 166/317 |
| 4,401,158 | | 8/1983 | Spencer et al. | 166/51 |
| 4,627,488 | | 12/1986 | Szarka | 166/51 |
| 5,211,234 | | 5/1993 | Floyd | 166/276 |
| 5,333,688 | * | 8/1994 | Jones et al. | 166/278 |
| 5,375,661 | | 12/1994 | Daneshy et al. | 166/278 |
| 5,392,850 | | 2/1995 | Cornette et al. | 166/51 |
| 5,921,318 | | 7/1999 | Ross | 166/250.17 |

* cited by examiner

*Primary Examiner*—William Neuder
(74) *Attorney, Agent, or Firm*—Cantor Colburn LLP

(57) ABSTRACT

A system for enhancing hydrocarbon production in long and deviated subterranean wells. Gravel is placed in the annulus between the screen liner and the borehole, together with annular isolation elements. Selective flow control is achieved. Sequential control or commingled production is achievable from multiple producing intervals of the borehole. A differential valve is incorporated in the screen liner service string to allow for gravel placement across multiple screen-liner sections, separated by annular isolation elements in a continuous one stage placement operation, thereby reducing time and complexity of such operations.

17 Claims, 11 Drawing Sheets

HYDROCARBON PREPARATION SYSTEM FOR OPEN HOLE ZONAL ISOLATION AND CONTROL

This application claims the benefit of an earlier filing date from U.S. Ser. No. 60/106,794, filed Nov. 3, 1998.

BACKGROUND OF THE INVENTION

1. Field of the Invention

The invention relates to the oil field industry. More particularly, the invention relates to hydrocarbon production systems in highly deviated (>55° deviation) wellbores.

2. Prior Art

Highly deviated or horizontally disposed wellbores have been employed in growing numbers in recent years to access oil reservoirs not previously realistically productible. In an open hole completion however, and especially where there is water closely below the oil layer or gas closely above, highly deviated or horizontal wells are much more difficult to produce.

Pressure drop produced at the surface to extract oil from the formation is as its highest at the heel of the highly deviated or horizontal well. In an open hole well, this causes water or gas coning and early breakthrough at the heel of (or any part of) the highly deviated or horizontal well. Such a breakthrough is a serious impediment to hydrocarbon recovery because once water has broken through, all production from the highly deviated or horizontal is contaminated in prior art systems. Contaminated oil is either forsaken or separated at the surface. Although separation methods and apparatuses have become very effective they still add expense to the production operation. Contamination always was and still remains undesirable.

Another inherent drawback to open hole highly deviated or horizontal wells is that if there is no mechanism to filter the sand or formation solids prior to being swept up the production tubing, a large amount of solids is conveyed through the production equipment effectively sand blasting and damaging the same. A consequent problem is that the borehole will continue to become larger as sand is pumped out. Cave-ins are common and over time the sand immediately surrounding the production tubing will plug off and necessitate some kind of remediation. This generally occurs before the well has been significantly depleted.

To overcome this latter problem the art has known to gravel (gravel being used according to the vernacular; gravel, sand, and similar particulate matter) pack the highly deviated or horizontal open hole wells to filter out the sand and support the bore hole. As will be recognized by one of skill in the art, a gravel packing operation generally comprises running a screen in the hole and then pumping gravel therearound in known ways. While the gravel (such as gravel, ceramic beads, sand etc.) effectively alleviates the latter identified drawbacks, water or gas coning and breakthrough are not alleviated and the highly deviated or horizontal well may still be effectively occluded by a water breakthrough.

To achieve zonal isolation, the art has known to gravel pack multiple stages between pre-activated isolation devices (such as external casing packers (ECP) etc.). This operation is known to be complex, time consuming and at high risk.

Since prior attempts at enhancing productivity in highly deviated or horizontal wellbores have not been entirely successful, the art is still in need of a system capable of reliably and substantially controlling, monitoring and enhancing production from open hole highly deviated or horizontal wellbores.

SUMMARY OF THE INVENTION

The invention teaches a system that effectively creates a gravel pack on both sides of a non-activated annular seal (NAAS), allowing the seal to be activated to set against a casing or open hole. More specifically, the gravel when placed by the system of the invention, skips over the NAAS and leaves virtually no gravel around the NAAS when the annular velocity is above critical settling velocity. The beneficial effects of the invention are obtained by causing the gravel to stall in an area upstream of the NAAS by preventing leak-off downstream of the NAAS. When sufficient pressure builds in the gravel carrier fluid, due to flow restriction caused by the tightly packed gravel upstream of the NAAS, a valve opens upstream of the NAAS and gravel begins to pack the downstream section.

This invention allows the gravel placement in continuous pumping operation, prior to activation of the AS devices.

An additional benefit of the valve structure of the invention is that prior art limits on the length of a gravel pack are avoided. More specifically, because of the valves of the invention pump pressures do not continue to climb as they do in the prior art. Thus with the invention pressures do not reach the fracturing pressures, the avoidance of which limited prior art pack lengths.

DETAILED DESCRIPTION OF THE PREFERRED EMBODIMENTS

Figure 1:
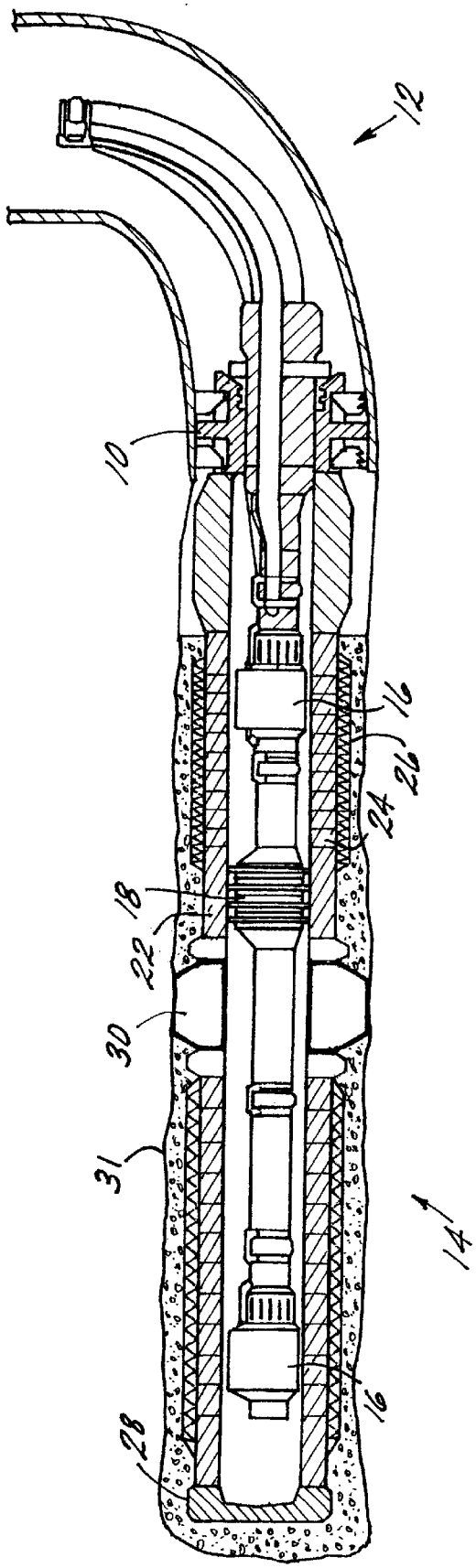
FIG. 1 is a schematic cross section view of an open hole zonal isolation and control system of the invention.

Referring to FIG. 1, in order to most effectively produce from a hydrocarbon reservoir where a highly deviated or horizontal wellbore in an open hole formation is indicated, a gravel pack is ideally constructed. Moreover the gravel packed area is most desirably zonally isolatable. Such zonal isolation is, pursuant to the invention, by way of annular seal (AS) (i.e hydraulic packer, ECP or mechanical packer) at selected intervals or hydraulically isolated with composite material or cement (curable materials). To complete the system, a production string including flow control devices may be run into the hole, each zone being isolated by a locator and a seal. This production string may be omitted, allowing for subsequent internal zonal isolation in the life of the well. The various components of the system are illustrated in FIG. 1 wherein those of skill in the art will recognize a liner hanger or sand control packer 10 near heel 12 of highly deviated or horizontal wellbore 14. From liner hanger 10 hangs a production string that may include flow control device 16 which may be hydraulic, mechanical, electrical, electromechanical, electromagnetic, etc. operated devices such as sliding sleeves and seal assembly 18. Seal assembly 18 operates to create selectively controllable zones within highly deviated or horizontal wellbore 14. Seal assemblies 18 (in most cases there will be more than one though only one is depicted in FIG. 1) preferably seal against a polished bore in the original gravel packing basepipe 22 which remains in the hole from the previous gravel packing operation. Also visible are ports 24 in basepipe 22 with screen 26 thereover. Roller 30 is illustrated in the net position evidencing substantially no gravel between its outer perimeter and the borehole well 31.

Figure 2:
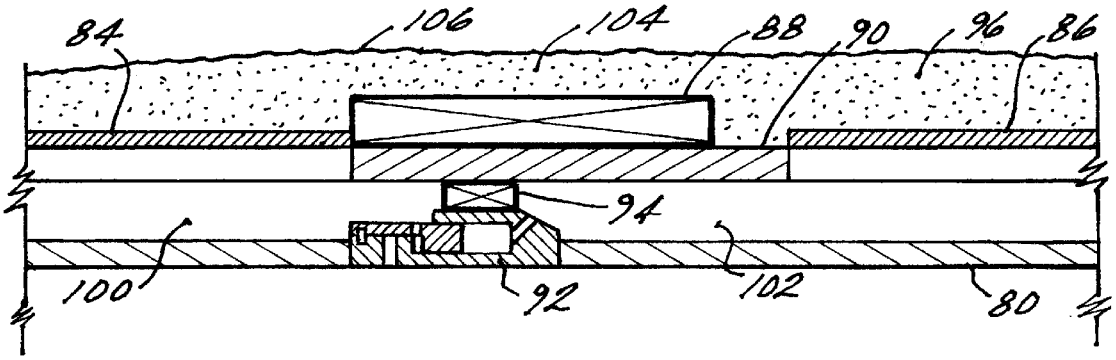
FIG. 2 is a schematic cross section view of a gravel packing zonal isolation embodiment of the invention where a secondary valve is closed.
Figure 3:
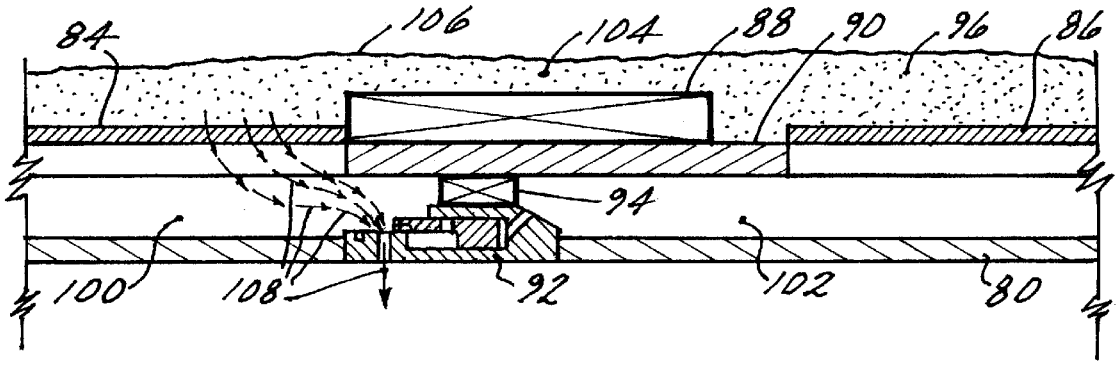
FIG. 3 is the embodiment of FIG. 2 where the secondary valve is open.
Figure 4:
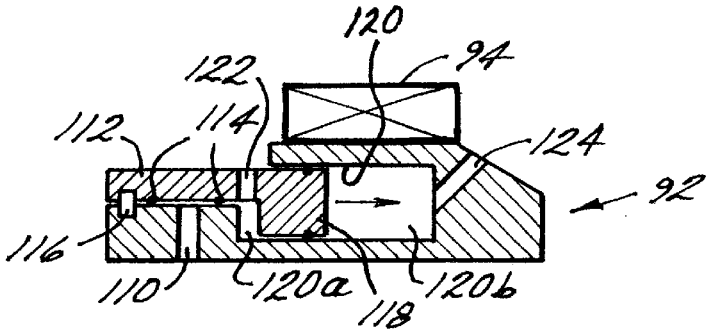
FIG. 4 is one embodiment of the valve for use in the embodiment of FIGS. 2 and 3.

Referring to FIGS. 2–4, an annular seal (AS) is employed to create the zonal isolation. Traditionally, AS's are expanded (set) against the gravel pack because gravel will have settled thereover in the packing operation. The gravel between the open hole or casing and the AS is a leak path and is undesirable. To render the AS more effective, the present inventors have developed a system which effectively packs both uphole and downhole of an AS and deposits virtually no gravel over the AS.

Referring to FIG. 2, basic components will first be identified for frame of reference. Washpipe 80 is located inside base pipe 82 which is screened 84, 86 in a generally conventional manner. AS 88 is located centrally. In a preferred arrangement a blank section 90 is located immediately downhole of AS 88 to collect overflow gravel from the uphole edge of the downhole screen. Without the blank section, the overflow would spill out over the AS and reduce the effectiveness of the invention. Washpipe 80 preferably includes a valve 92 with a seal 94 just downhole of the valve 92, the seal spanning the annulus defined by the OD of washpipe 80 and the ID base pipe 82. It should be understood that only a section of the portion of the well being gravel packed is illustrated and that the gravel packing activities of pumping a loose slurry of gravel downhole through a crossover, through a screen and back uphole through the end of the washpipe should still be considered the operation undertaken relative to the invention. The difference being shown in the figures and disclosed hereunder.

Again referring to FIG. 5, the normal gravel packing action starts with the α wave and leak-off fluid being drawn through screen 86 and to the end of washpipe 80 (end not shown). As is known the α wave will continue to the bottom of washpipe 80 and then begin a β wave back uphole. The β wave propagates gravel deposition back up and over the top of the annulus around screen 86. As the β wave nears the AS however, movement uphole thereof stops because there is no leak-off (necessary for deposition) above AS 88. The result is that the gravel pack 96 below AS 88 is very tight and the pressure of the gravel carrier fluid increases on the area uphole of AS 88. Since there is no leak-off uphole of AS 88 no more gravel is deposited. One should understand that there is no leak-off under screen 84 because of seal 94. Without seal 94, leak-off would occur from under screen 84 and simply flow to the end of washpipe 80. Seal 94 prevents such flow and creates the above described condition.

As pressure increases in the annulus 100 to a preselected differential over the pressure in annulus 102, the valve 92 opens which in effect moves the end of the washpipe 80 to uphole of seal 94. Immediately upon opening of the valve 92 there is a leak-off path (see flow lines 108 in FIG. 3) from under screen 84 to washpipe 80 and the β wave progresses thereto. Since the annular area 104 between AS 88 and the open hole 106 is relatively narrow, the velocity of fluid traveling therethrough is high which prevents the deposition of gravel. Thus gravel is not deposited until it reaches screen 84 where leak-off is present and the velocity of the fluid slows. Thus, the β wave skips over the AS 88 and resumes over screen 84. Such skipping will occur in any location where the construction is as stated regardless of the number of AS's used. Because of the valve structures used, the pressure across the valve actuator will always be balanced until the downhole section is packed up and pressure thereabove increases. This allows multiple units to be run simultaneously. This will be more clear from the following discussion of the valve embodiments.

The ASs can then be inflated conventionally with assurance that the OD thereof will be in contact with the formation at open hole boundary 106 and not a segment of packed gravel. Hereby a reliable isolation between zones is established.

Referring to FIG. 4, one embodiment of the valve for the zonal isolation system of FIGS. 2 and 3 is illustrated. For clarity, only the valve structure itself and seal 94 are illustrated. It should be understood that the intended environment for the valve is as shown in FIGS. 2 and 3.

Valve 92 includes flow port 110 which connects the interior of washpipe 80 to the annulus 100 allowing fluid from annulus 100 to go to the washpipe 80. The valve will be initially closed by sleeve 112 having seals 114. Such position (closed) is preferably ensured by a shear out member 116 such as a bolt. The sleeve 112 is connected to and operable in response to a piston 118 which rides in a bore 120 that is bifurcated into chamber 120*a* and 120*b* by the piston 118. Provision is made to allow chamber 120*a* to "see" annulus 100 pressure while chamber 120*b* "sees" annulus 102 pressure. When annulus 100 pressure exceeds annulus pressure by a preselected amount of about 20 to about 500 psi, the bolt 116 shears and the sleeve 112 shifts to open port 110. In the drawing, chamber 120*a* is provided with the pressure information through channel 122 and chamber 120*b* is provided with the pressure information through channel 124. These are but examples of channels that can be employed and it is important to note only that the channels or other "pressure sensors" (computer sensors being an alternative where the sleeve is opened electrically or mechanically other than simply hydraulically) should be exposed to pressure on opposite sides of the seal 94.

Figure 5:
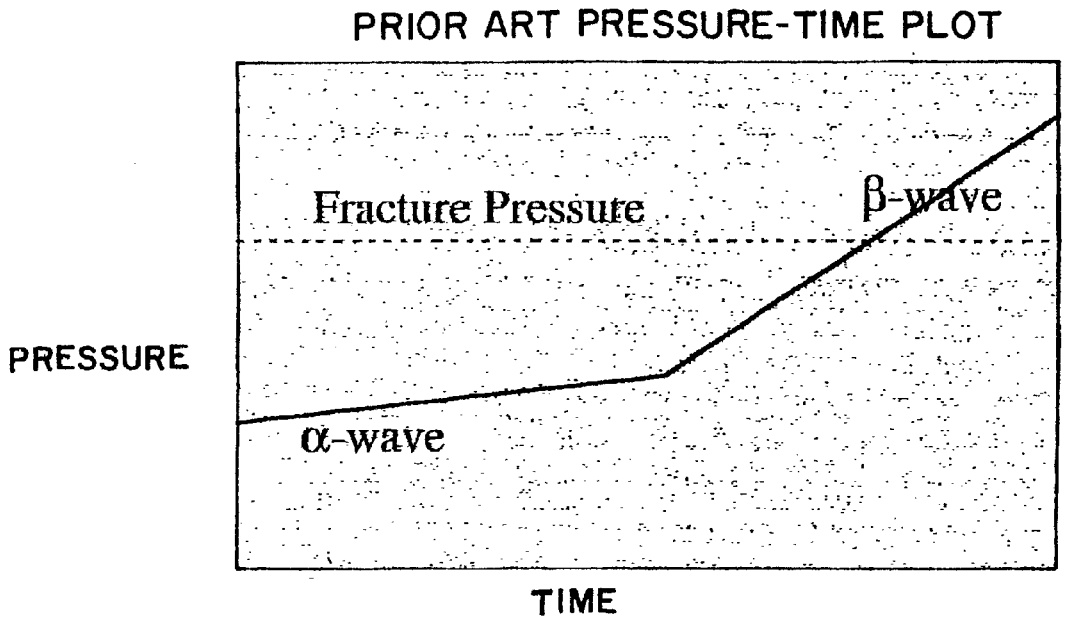
FIG. 5 prior art pressure—time plot.
Figure 6:
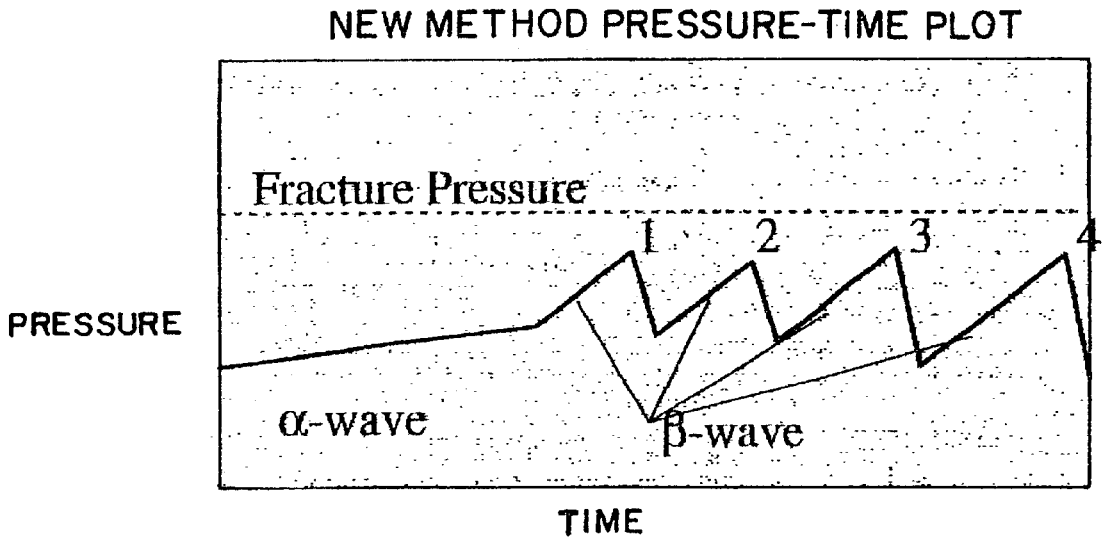
FIG. 6 is the new invention pressure—time plot.
Figure 7:
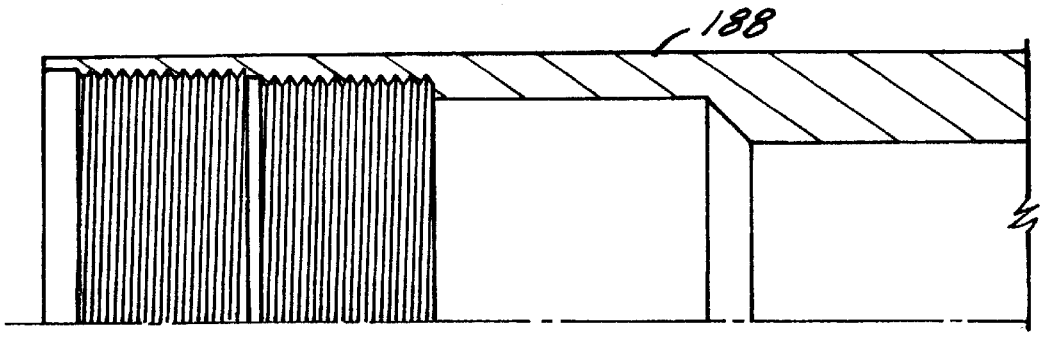
FIGS. 7–14 is another valve embodiment of the invention in a closed position.
Figure 15:
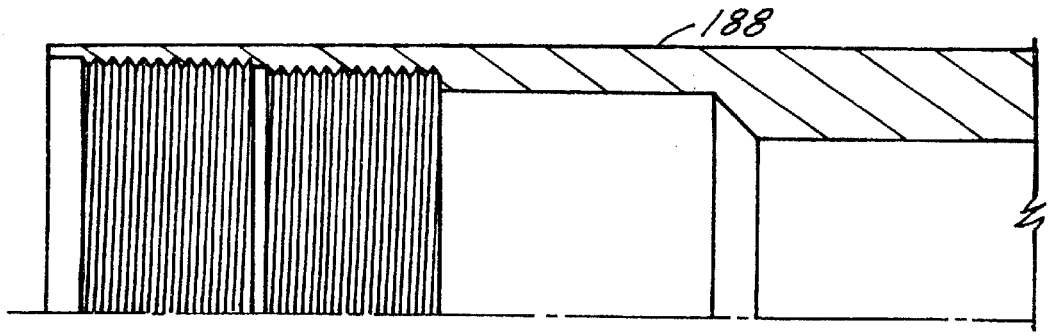
FIGS. 15–22 is another valve embodiment of the invention in an unlocked position.
Figure 23:
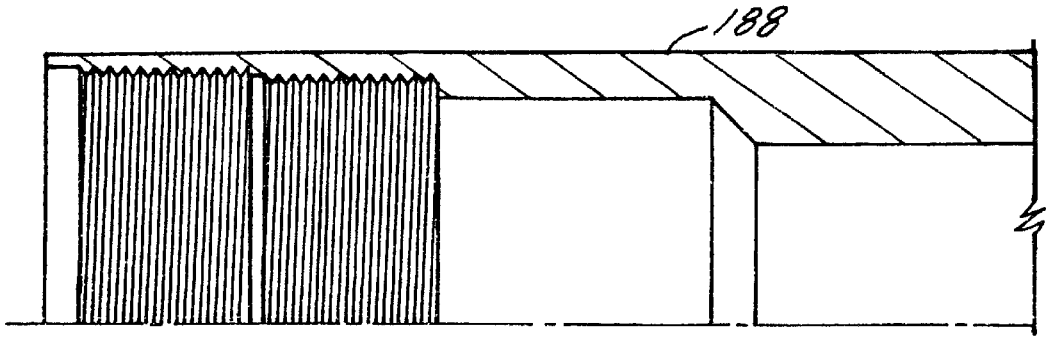
FIGS. 23–30 is another valve embodiment of the invention in an open position.
Figure 8:
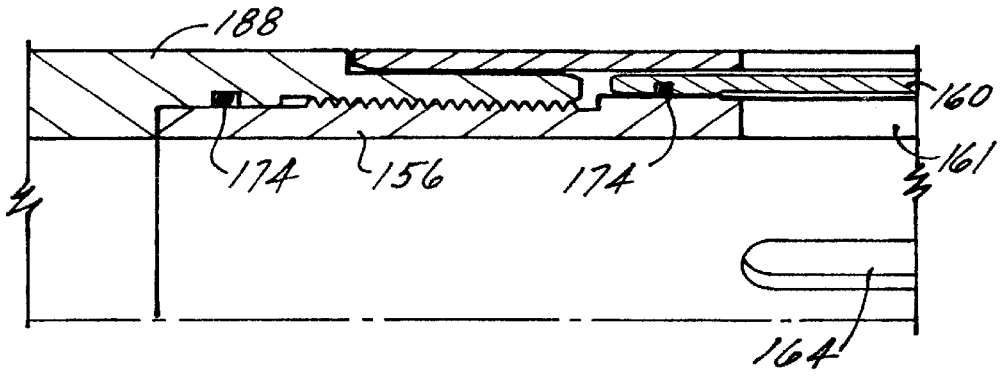
Figure 16:
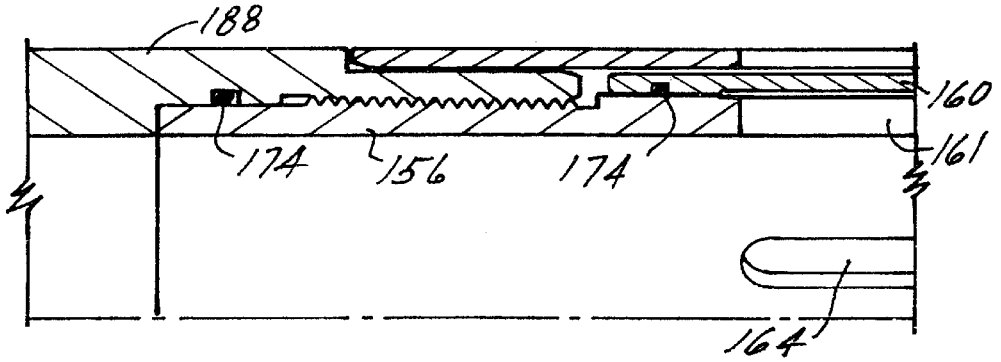
Figure 24:
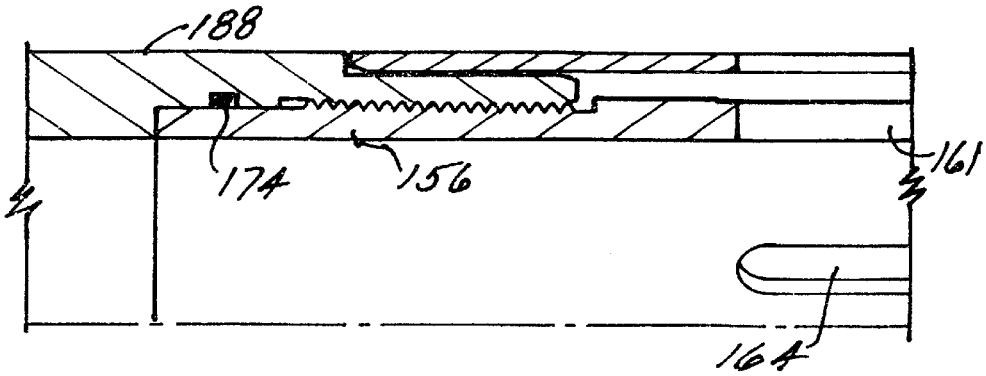
Figure 9:
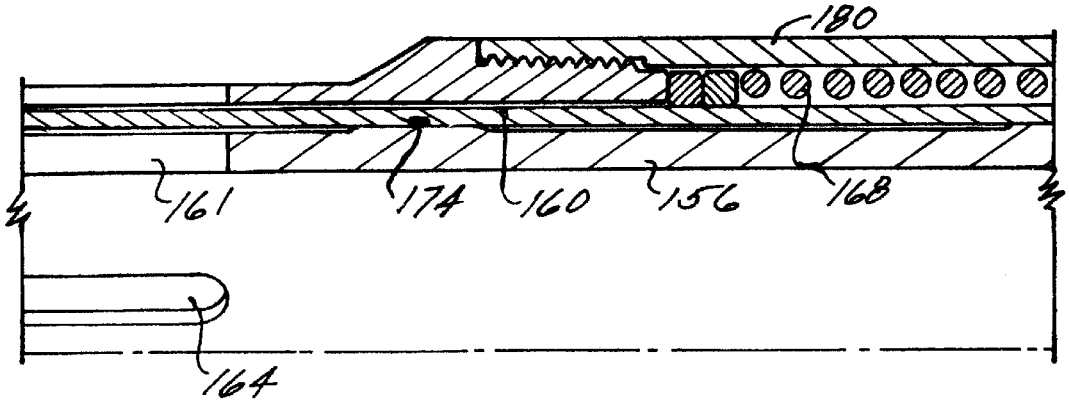
Figure 17:
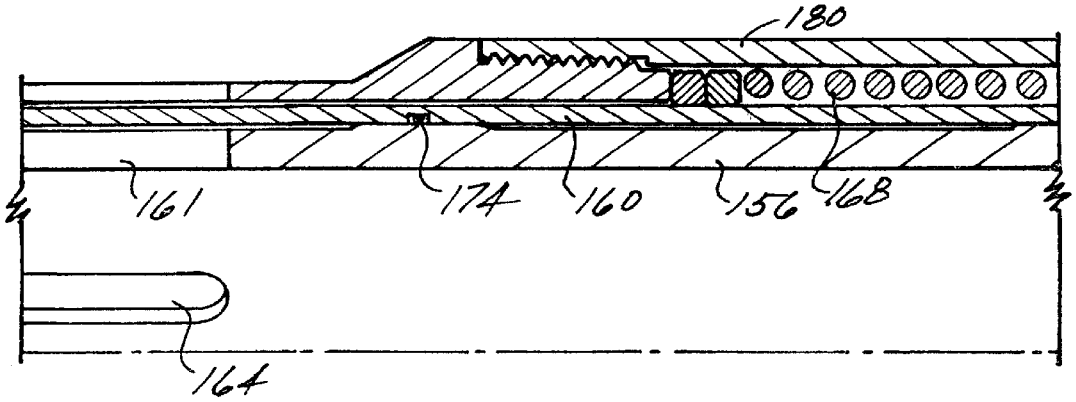
Figure 25:
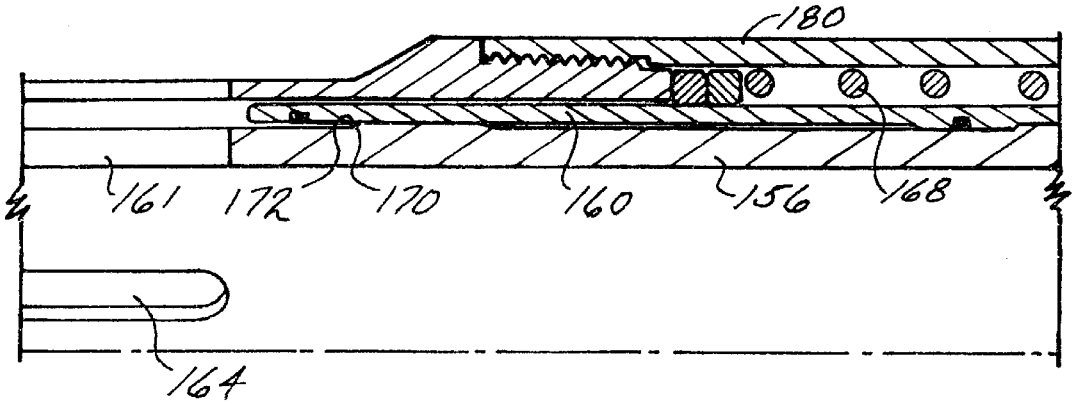
Figure 10:
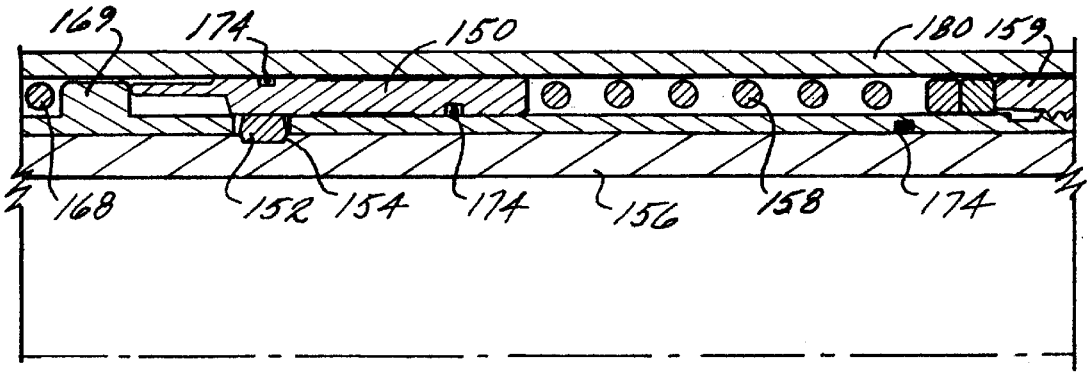
Figure 18:
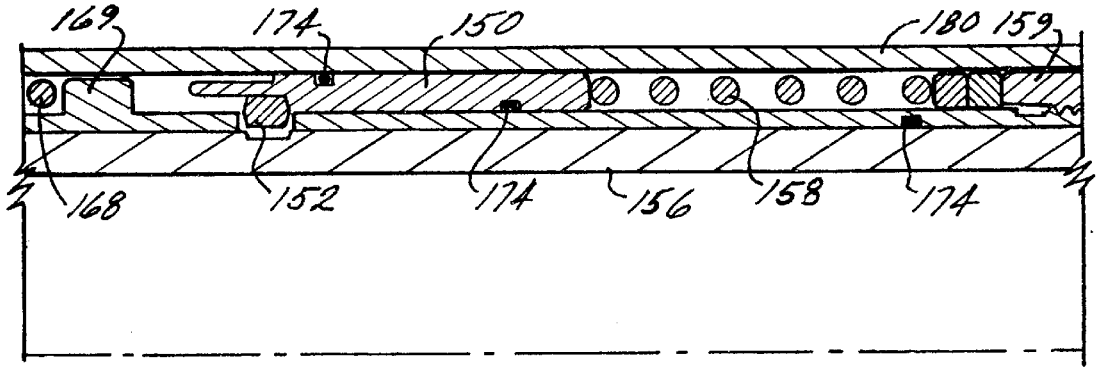
Figure 26:
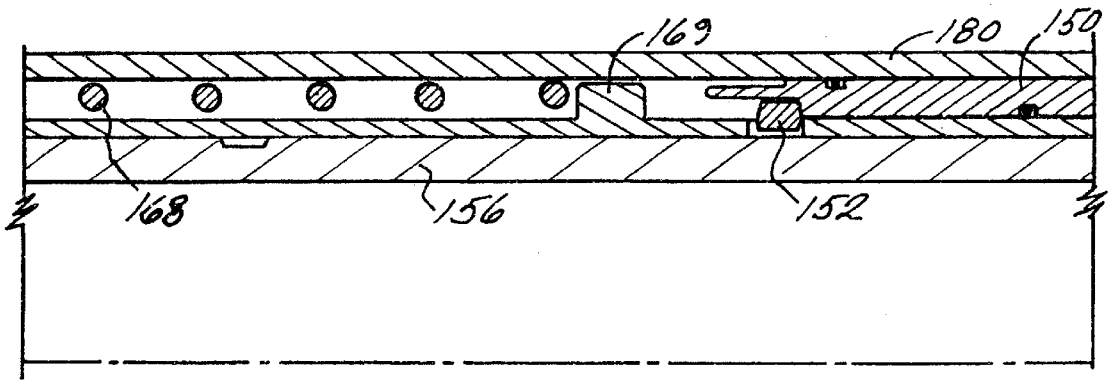
Figure 11:
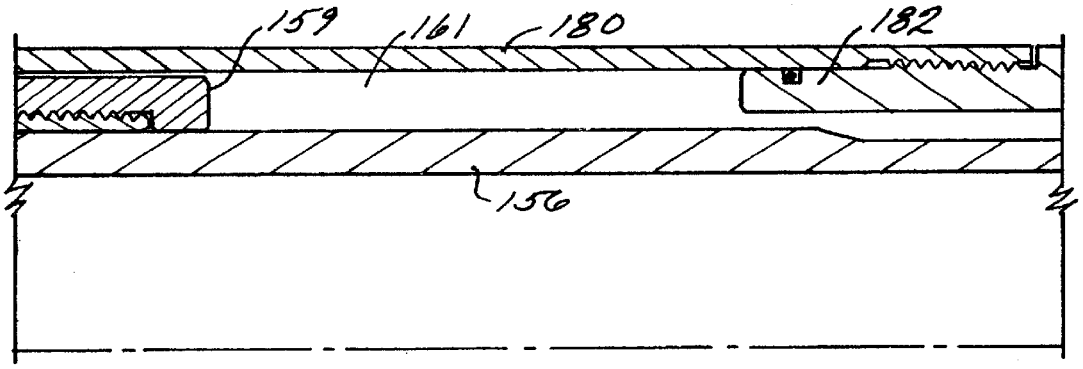
Figure 19:
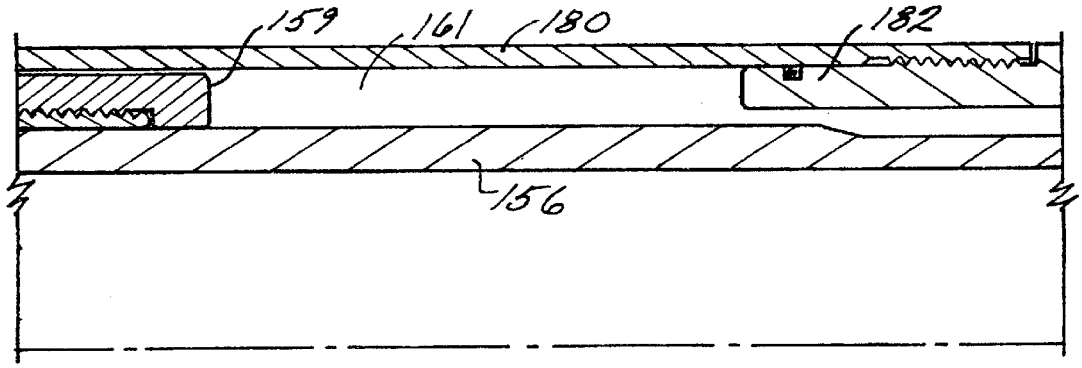
Figure 27:
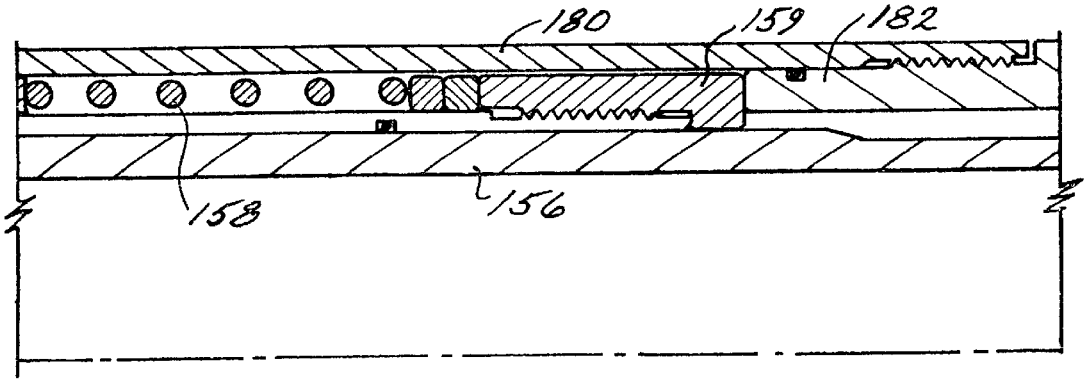
Figure 12:
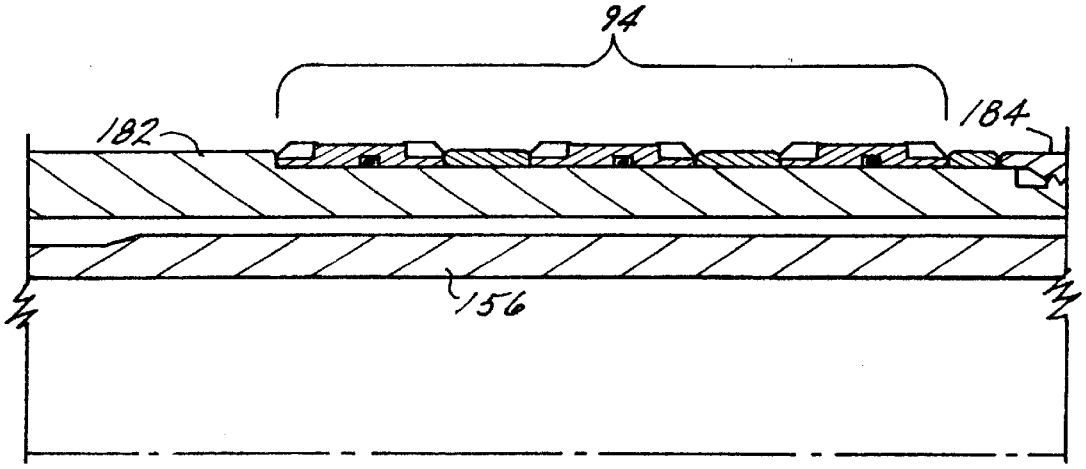

An additional benefit of the invention is that long runs of gravel material can be installed without gravel fluid carrier pressure increase because of the valves employed in the invention. The pump pressure difference for the beta wave is illustrated in FIGS. 5 and 6 where the invention (FIG. 6) shows a saw tooth pressure pattern which keeps pressure low.

Figure 20:
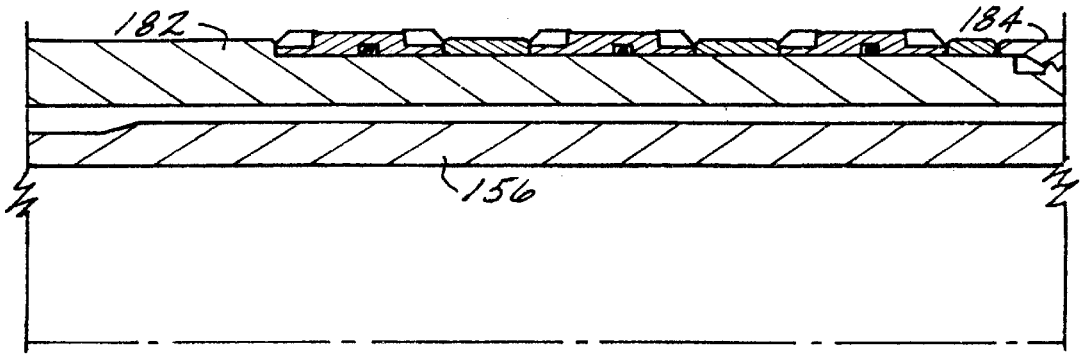
Figure 28:
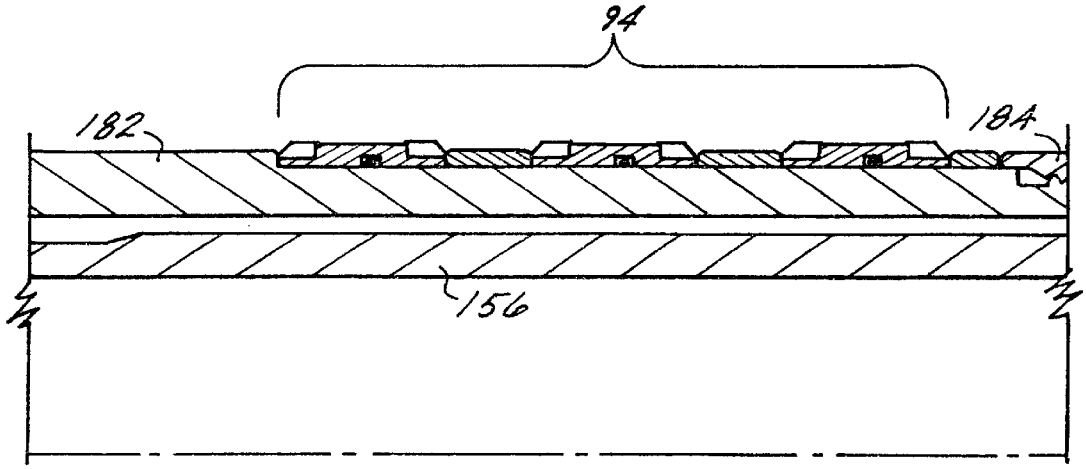

In another embodiment of the valve component of the invention, reference is made to FIGS. 7–30, which are broken up to FIGS. 7–14; 15–22; and 23–30 to illustrate three distinct conditions of the same valve. For frame of reference, seal 94 in this embodiment of the valve of the invention can be found in FIGS. 12, 20 and 28 and preferably is a bonded seal stack. A bonded seal stack is a phrase known to the art and requires no specific discussion. Such a seal arrangement is commercially available from a wide variety of sources.

Referring now to FIGS. 7–14, the valve portion of the invention is illustrated in a closed position. This is the position for run in of the washpipe and it is the position in which the valve will remain until the gravel packing operation causes pressure to rise in the area uphole of seal 94 as hereinbefore described.

Figure 13:
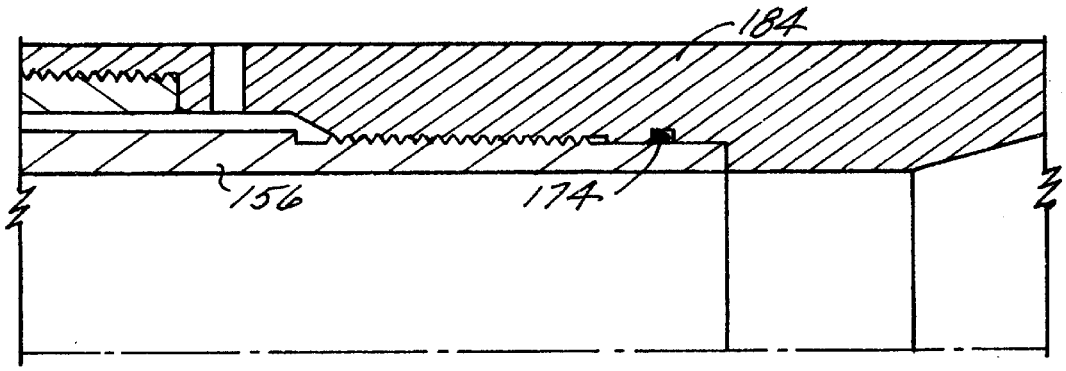
Figure 21:
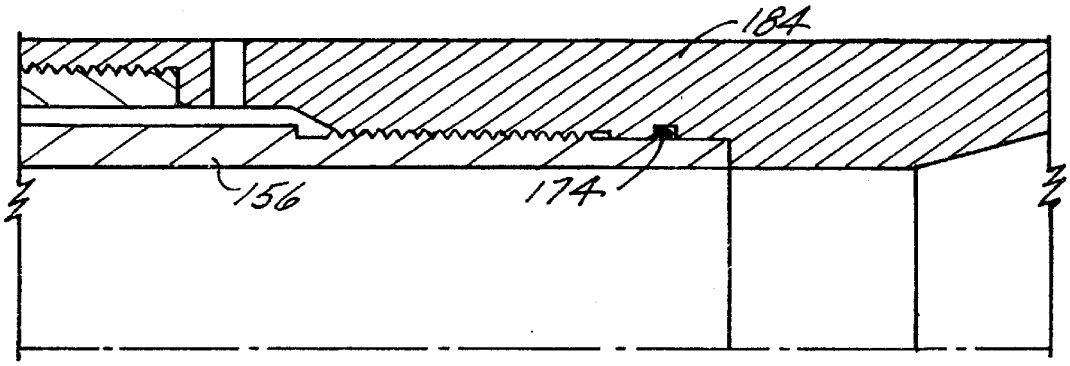
Figure 29:
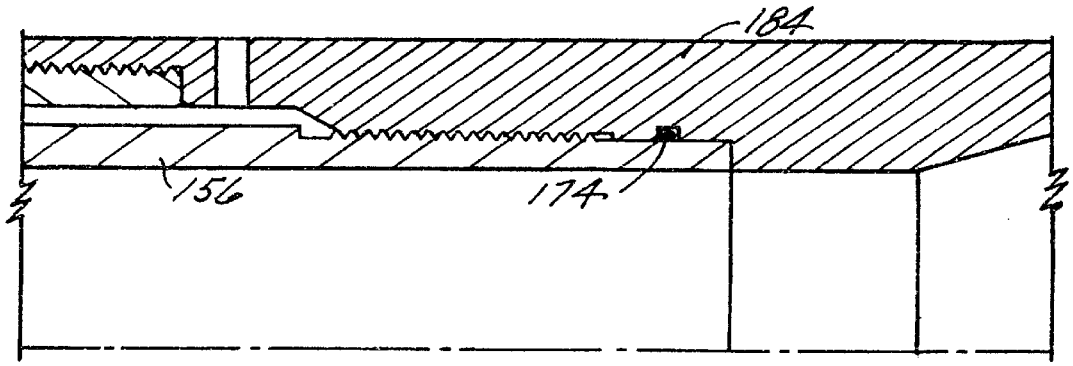
Figure 14:
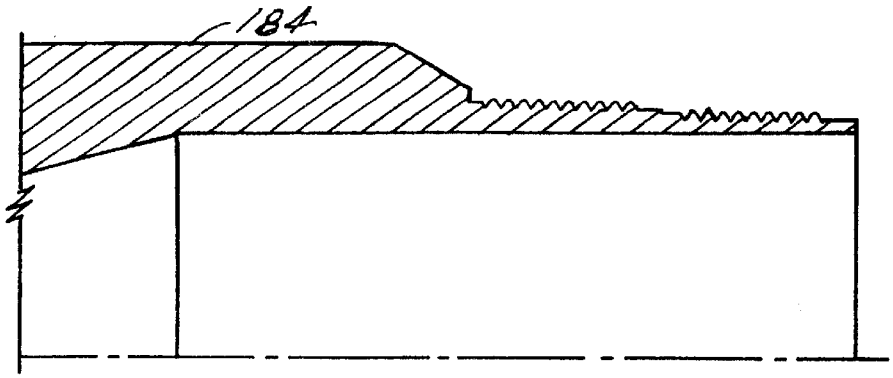
Figure 22:
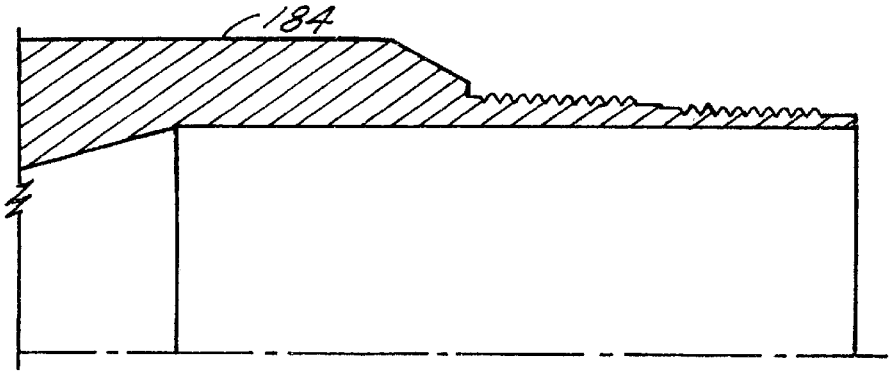
Figure 30:
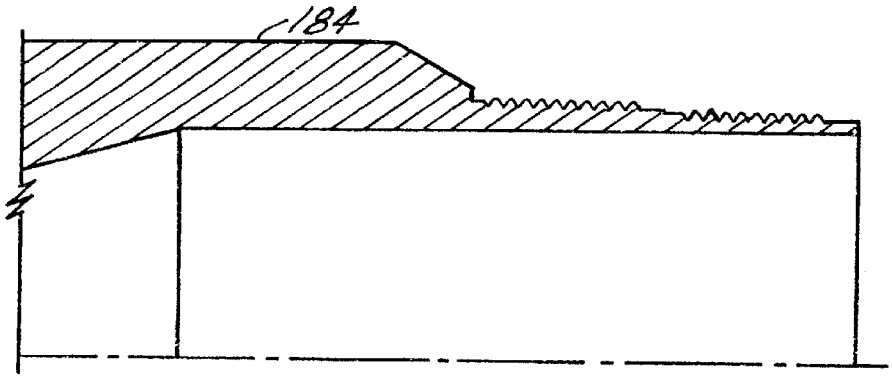

The valve is locked closed by lock piston 150 which prevents lock ring 152 from disengaging with groove 154 on washpipe 156. The lock piston is also biased in the locked position by spring 158 which is what preselects the pressure differential required to unlock the tool. Spring 158 is bounded by nut 159 which is threadedly attached to sleeve 160. One will note that annulus 161 (FIG. 11) has been left open for receipt of the sleeve 160 and its actuation assemblies when opened. More specifically, pressure in the area uphole of the seal 94 is "seen" by the uphole end of lock piston 150; pressure downhole of seal 94 is "seen" by the downhole side of piston 150. Thus, the pressure downhole in addition to the spring 158 bias must be overcome for uphole pressure to unlock the tool. The pressure path for the uphole pressure is along the OD of the closing sleeve 160. Downhole pressure is accessed downhole of seal 94 at port 162 (FIG. 13).

Referring to FIGS. 15–22, once the pressure uphole of seal 94 reaches the preselected differential to that downhole thereof, the tool will be in the condition set forth in FIGS. 15–22, i.e, the lock piston 150 will move downhole off of lock ring 152 which then disengages from groove 154. There is no longer anything holding the closing sleeve 160 closed and the same pressure that opened lock piston 150 will, in conjunction with spring 168 which bears against spring stop 169, urge the closing sleeve 160 into the open position by shifting the sleeve downhole of the ports 164. The open condition is illustrated in FIGS. 23–30 where the sleeve has moved completely off ports 164 and has come to rest on land 170 with shoulder 172 of sleeve 160 bearing thereagainst. Suitable seals 174 have been placed throughout the tool to contain pressure where desired.

The operable components noted are contained between a sleeve cover 180 and the washpipe 156. Cover 180 is threadedly attached to seal sub 182 which then is attached via a acme thread to lower sub 184. One of skill in the art should note the lack of a seal 174 at the uphole junction of cover 180 and upper sub 188. This is part of the pressure path to the uphole area discussed above.

Since the provision of different zones and flow control devices in the invention allow the metering of the pressure drop in the individual zones, the operator can control the zones to both uniformly distribute the pressure drop available to avoid premature breakthrough while producing at a high rate. Moreover, the operator can shut down particular zones where there is a breakthrough while preserving the other zones' production.

After construction of one of the assemblies above described, and the washpipe has been removed, a production string is installed having preferably a plurality of the seal assemblies with at least one tool stop mechanism to locate the seal assemblies at points where the basepipe is smooth and the inner diameter is not reduced. Location may also be assured based upon the liner hanger 10. The seal assemblies allow different zones to be created and maintained so that selective conditions may be generated in discrete zones.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A hydrocarbon production system comprising:

a borehole in a hydrocarbon containing formation;

a continuous, one stage, gravel pack having a plurality of isolated zones;

at least one annular seal located between at least two zones of said plurality of zones; and a valve and seal located upstream of said at least one annular seal, said valve selectively allowing through passage of fluid from an annulus outside of a pipe upon which said at least one annular seal is located and to a space inside of said pipe.

2. A hydrocarbon production system as claimed in claim 1 wherein said valve and seal are adjacent said at least one annular seal.

3. A hydrocarbon production system as claimed in claim 2 wherein said gravel pack exists both upstream and downstream of said at least one annular seal while said at least one annular seal is free from said gravel pack and sealed against a formation wall or a casing.

4. A hydrocarbon production system as claimed in claim 3 wherein said at least one annular seal is an external casing packer or an open hole packer.

5. A hydrocarbon production system as claimed in claim 1 wherein said plurality of isolated zones are individually isolatable.

6. A hydrocarbon production system as claimed in claim 5 wherein each said at least one annular seal is adjacent a downhole blank pipe section.

7. A hydrocarbon production system as claimed in claim 6 wherein said valve of said valve and seal is selected pressure operable.

8. A gravel packing system to create a zonally isolated gravel pack comprising:

a base pipe;

a washpipe disposed within said basepipe a seal spanning an annulus between said basepipe and said washpipe a flow port communicating between a void defined within said washpipe and said annulus and located uphole of said seal; and a valve controlling said flow port.

9. A system as claimed in claim 8 wherein said valve is hydraulically controlled.

10. A system as claimed in claim 9 wherein said valve includes a closure member connected to a piston.

11. A system as claimed in claim 10 wherein said piston bifurcates a chamber and one side of said chamber is exposed to pressure on a downhole side of said seal while a second side of said chamber is exposed to pressure on an uphole side of said seal.

12. A system as claimed in claim 11 wherein said valve opens said flow port when said pressure on the uphole side of the seal is greater than the pressure on the downhole side of the seal by a selected amount.

13. A gravel packing system as claimed in claim 8 wherein said gravel packing system allows selective control of pressure drop in individual zones.

14. A method for building a gravel pack around an annular seal while leaving the annular seal unpacked comprising:

installing a slotted base pipe having an annular seal mounted thereon;

installing a washpipe inside said base pipe, said washpipe having an open end, and an openable valve;

installing a seal in an annulus defined by said washpipe and said base pipe, said seal being located between said openable valve and said end of said washpipe, said seal being located radially inwardly of said annular seal;

pumping gravel until a pressure differential in an annular area uphole of said seal is a predetermined amount greater than a pressure in an annular area downhole of said seal;

opening said valve in response to said pressure differential and pumping gravel until said gravel pack is completed.

15. A method as claimed in claim 14 wherein said opening said valve is automatic.

16. A method as claimed in claim 15 wherein said valve is piston operated and said pressure differential causes said valve to open.

17. A method for building a gravel pack as claimed in claim 14 wherein gravel in said pack skips over said annular seal leaving said annular seal substantially clear of gravel.

* * * * *